US006179751B1

(12) United States Patent
Clears

(10) Patent No.: US 6,179,751 B1
(45) Date of Patent: Jan. 30, 2001

(54) DEVICE FOR AMELIORATING TENNIS ELBOW

(76) Inventor: Weldon R. Clears, 50 E. 89th St., Apt. 14A, New York, NY (US) 10128

( * ) Notice: Under 35 U.S.C. 154(b), the term of this patent shall be extended for 0 days.

(21) Appl. No.: 09/417,322

(22) Filed: Oct. 13, 1999

(51) Int. Cl.[7] ..... A63B 23/16; A63B 23/14
(52) U.S. Cl. ..... 482/48; 482/44; 482/47
(58) Field of Search ..... 482/44, 47, 48; 606/75, 204

(56) References Cited

U.S. PATENT DOCUMENTS

| | | | | |
|---|---|---|---|---|
| 1,256,004 | * | 2/1918 | Finney | 482/48 |
| 3,612,521 | * | 10/1971 | Wendeborn | 272/67 |
| 4,105,200 | | 8/1978 | Unger . | |
| 5,062,625 | * | 11/1991 | Vonk | 272/67 |
| 5,136,911 | * | 8/1992 | Wyss | 84/468 |
| 5,326,340 | | 7/1994 | Coffey . | |
| 5,338,290 | | 8/1994 | Aboud . | |
| 5,405,357 | | 4/1995 | Rowe-Lanzisera et al. . | |
| 5,445,582 | * | 8/1995 | Brown | 482/48 |
| 5,453,064 | | 9/1995 | Williams, Jr. . | |
| 5,527,244 | | 6/1996 | Waller et al. . | |
| 5,529,550 | | 6/1996 | Maycock, Jr. et al. . | |

OTHER PUBLICATIONS

New York Times, Jan. 13, 1998, p. F9, Jane E. Brody, "The Arthritis is at Bay, Thank you".
Averbach, David M., "Tennis Elbow (Lateral Epicondylitis)" Southern California Orthopedic Institute, 1998.
Shaffer, Alyssa, "Tennis Elbow, anyone?" Tennis, Feb. 1999.

* cited by examiner

*Primary Examiner*—Stephen R. Crow
*Assistant Examiner*—Tam Nguyen
(74) *Attorney, Agent, or Firm*—John D. Upham

(57) ABSTRACT

A device for exercising the tendons and muscles affected by tennis elbow takes the preferred form of a closed band of elastic material of sufficient circumference to fit around the fingers and thumb of the hand. On the band are four finger loops and one thumb loop. The wearer repeatedly extends the fingers and thumb against the tension of the elastic band and then retracts them. This exercising of the inflamed tendons and muscles ameliorates over time the pain and discomfort of tennis elbow.

33 Claims, 3 Drawing Sheets

FIG. 1
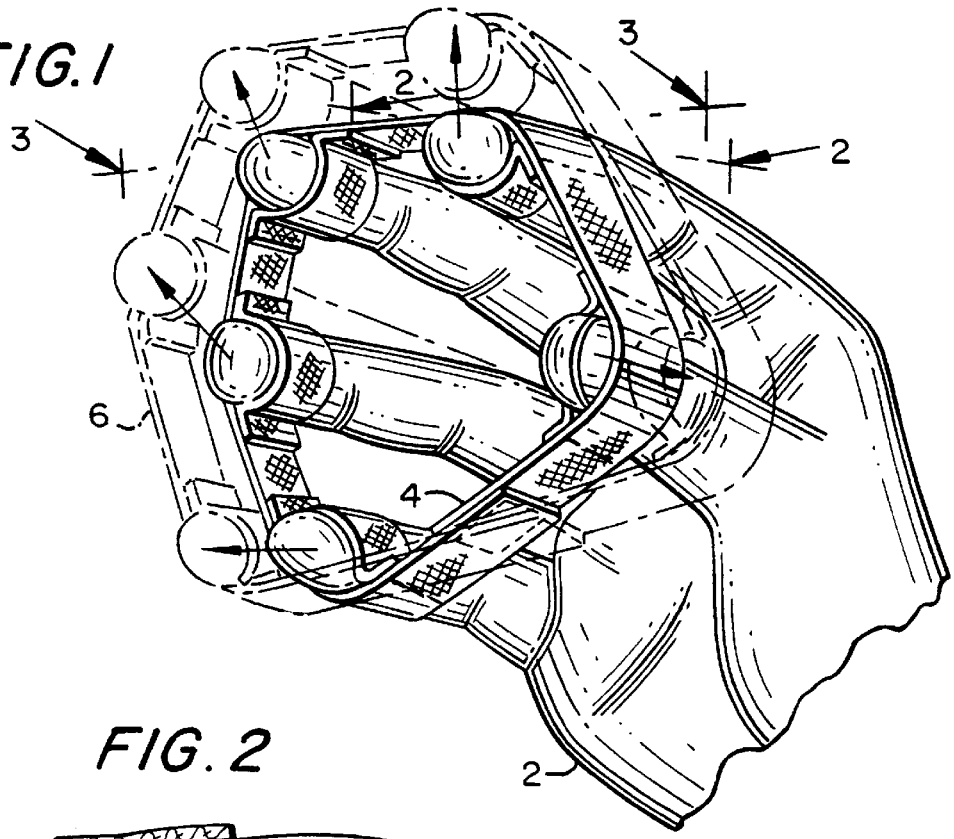
FIG. 2
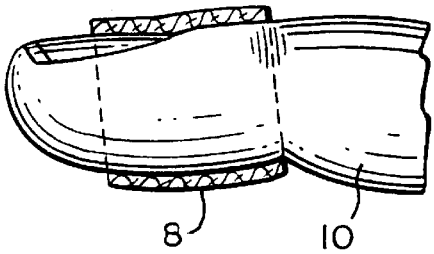
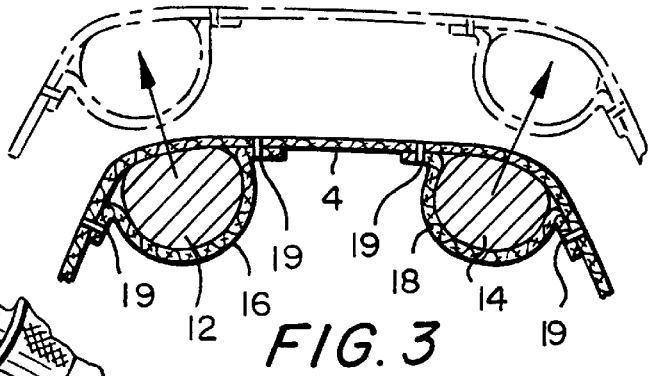
FIG. 3
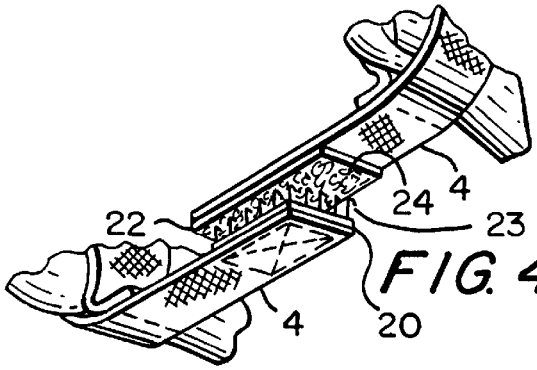
FIG. 4

DEVICE FOR AMELIORATING TENNIS ELBOW

BACKGROUND

"Tennis elbow," in its strictest meaning, is the common term used to describe lateral epicondylitis. This is a tendonitis of the extensor carpi radialis brevis, which attaches to the lateral epicondyl of the humeris. It may be caused by a sudden injury or by repetitive use of the arm. It may involve micro tears in the tendons that lead to a hyper-vascular condition resulting in pain. The pain is usually worse with strong gripping with the elbow in an extended position, as in a tennis back-hand stroke, but this problem can occur in golf and other sports as well as with repetitive use of tools.

It has been reported that nearly half of all recreational players age 30 or older have suffered from tennis elbow symptoms, which may arise from tennis backhands and serves. Incidence of the malady has increased with the introduction of new tennis technologies, especially longer racquets and tighter stringing. Tennis elbow can arise not only from sports and working with tools, but also from simply picking up an object with the arm extended.

Lateral epicondylitis refers to inflammation of the tendons that attach the extensor muscles of the forearm to the outer portion of the bony prominence of the elbow, which is the lateral epicondyle. The resulting pain tends to be felt in the outer portions of the elbow and forearm. Tennis elbow pain coming from the inner portion of the elbow may be designated as medial epicondylitis wherein tendons of the extensor muscles that are attached to the medial epicondyle are inflamed.

The term "tennis elbow" is often applied to any pain in the elbow or forearm.

All sorts of treatments of tennis elbow have been suggested. These range from internal and external medications, heat, cold, ultrasound, to surgery. Many kinds of devices have been sold or described, including braces, magnets, slings, stretching devices.

U.S. Pat. No. 4,105,200 to Unger discloses a hand and finger exercise device for treating ailments such as "tennis wrist" and "tennis elbow." A cylinder the diameter of a tennis racquet handle is grasped in the hand of the user. Three elasticized straps run longitudinally along the cylinder. One fits over the fingers adjacent to the knuckles, another over the fingers adjacent to the finger tips, and a third over the thumb. The user squeezes the cylinder, then flexes fingers and thumb outwardly against the straps. The straps constrain the fingers and thumb so that they can only uncurl in unison and cannot move laterally away from each other.

U.S. Pat. No. 5,527,244 to Waller and Tobin provides a bidirectional exercise glove in which rods embedded along the fingers of the glove, or thick molded regions formed integrally with the glove, resist flexion and extension of the fingers.

U.S. Pat. No. 5,338,290 to Aboud teaches an elastic variable tension device for relieving pain due to a variety of ailments, including tennis elbow. The device comprises a stack of multiple elastic strips, and hook and loop fasteners for securing the device with tension around a part of the body suffering pain.

An article in the New York Times of Jan. 13, 1998, page F9, describes exercises to help arthritic hands. One, with an illustration, states in its entirety: "Put a rubber band around the hand. Using the thumb as an anchor, try to separate the fingers. If this doesn't make your fingers tired after a few repetitions, use a stronger rubber band."

BRIEF SUMMARY OF THE INVENTION

The invention is a device for exercising the tendons and muscles affected by tennis elbow by allowing controlled motion of the fingers and thumb. A preferred device takes the form of a closed band of elastic material of sufficient circumference to fit around the tips of the fingers and thumb of the hand; on the band are four finger retainers and one thumb retainer. The retainers, which may be loops, fit snugly around the tips, i.e. the distal segments, of their respective digits. Preferably the band is sized to fit comfortably around all five digits of the normal partly open relaxed hand, and the retainers are spaced from each other to correspond comfortably with the spacing of the fingers and thumb of the normal partly open relaxed hand. The wearer repeatedly extends the fingers and thumb against the tension of the elastic band and then retracts them. This exercising of the inflamed tendons and muscles ameliorates over time the pain and discomfort of tennis elbow. It may also be helpful in cases of carpal tunnel syndrome.

An advantage of the invention is that a single device may be used interchangeably with either the left or the right hand.

THE DRAWINGS

The drawings are not to scale.

FIG. 1 shows in solid lines a hand in the partly open relaxed position, with a preferred form of the invention thereon. It shows in dashed lines the fingers and thumb extended, with solid arrows running from fingertips and thumbtip to the corresponding extended tips.

FIG. 2 is a view along the sight line 2 of FIG. 1, showing a finger loop around the distal segment of a finger.

FIG. 3 is a cross-section of two fingers along the plane indicated by the numeral 3 in FIG. 1.

FIG. 4 illustrates how the elastic band can be adjusted in circumference by providing a VELCRO fastener on two ends of the band.

DETAILED DESCRIPTION

Figure 6:
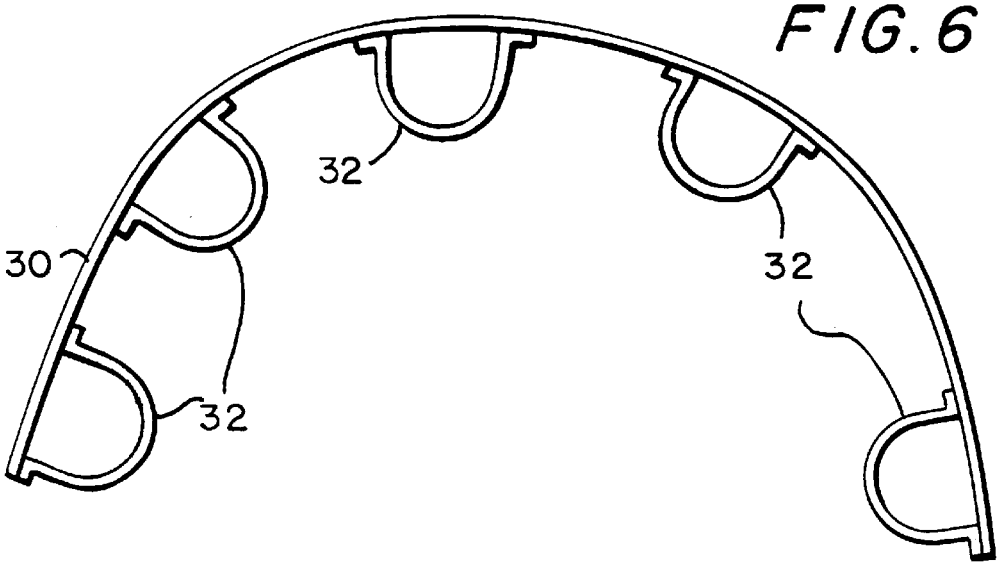
FIG. 6 illustrates a form of the invention in which the elastic band is open rather than closed, i.e., it has two unattached ends.

In FIG. 1, numeral 2 designates a hand in a normal relaxed position. Whether the fingers are horizontal, pointing upward, or pointing downward, when relaxed the normal hand is partly open. In general, the four fingers are roughly equidistant from adjacent fingers, though often there is a little more space between the ring and little fingers, and sometimes between the middle and index fingers. The fingers and the thumb when relaxed are shown in solid lines, and when extended are shown in dashed lines. The elastic band is shown in the normal position by 4, and in the extended position by 6. In a device for adult hands, the width of the band may be from about one-half to about one to 1½ inch. Since the band is normally worn around the distal segments of the digits, a band may be chosen whose width is from about one-half to about three-fourths of the average length of the digital segments of the individual wearing the band.

The relaxed band 4 is made from a material of sufficient elasticity to span the distance from the little finger tip to the thumb tip when in the fully extended position, i.e. they are extended outward away from the palm and also are spread out away from each other. When the hand is relaxed, band 4 may be non-stretched or may be somewhat stretched. When the fingers and thumb are fully extended, band 4 may be at its fullest extension, or preferably still retains the ability to stretch further. The band should at all times during the extending and retracting provide tension between and amongst all the fingers and thumb. Band 4 is of sufficient durability to withstand many thousands of stretches.

Band 4 may be made of an elasticized fabric, such as SPANDEX or LICREA, containing elastic fibers; it may be made of a molded elastomer such as a compression molded synthetic or natural rubber; it may be molded by extruding or injection molding a thermoplastic elastomer. Rubber and thermoplastic elastomers may be formulated with pigments, fillers, processing aids, plasticizers, antioxidants, cross-linking agents, or other additives, as is within the skill of the art. Whatever the material, it will be chosen to provide the elasticity and durability as described herein.

The distal section of each digit, i.e., the section containing the phalanx bone and terminating in the fingertip (also identified as the portion of the finger distal to the distal inter-metacarpal joint), has a snugly fitting retainer or holder which preferably is a loop, around it. (To avoid clutter in the drawing, the loops are not given a reference numeral in FIG. 1.) The loops are attached to, or may be molded integral with, the inner surface of band 4. By "snugly fitting" is meant that the loops may fit tightly or loosely but not so loose that they would slip off as the fingers and thumb are extended and retracted.

The preferred position of the band and loops is around the distal sections of the digits. However, it is possible to size the loops to allow them to slip over the first joint onto the next section of the digit. This does not allow as great an extension and thus provides less exercise.

Advantageously the inner surface of the loops frictionally engages the skin. The inner surface may be roughened, or may inherently be of a substance, e.g., an elastomer such as rubber, that provides some elasticity as well as friction. Only a small amount of friction and/or a reasonably snug fit is sufficient. It should not be difficult to slip the fingers and thumb into their loops as the device is being mounted on the hand.

The loops in FIG. 1 are the same width as band 4, but they may be somewhat narrower or wider. For the average adult hand, diameters of the finger loops when on the fingers may be about ⅝ to about ¾ inch and of the thumb loop when on the thumb about ¾ to about 1 inch. The important thing is that they are comfortable on the fingers and thumb as the fingers and thumb are extended and retracted.

Preferably the loops are made of elastic material, the same as or different from that of the band. The band and the loops may be molded together so that they constitute a single integrated structure.

While FIG. 1 shows the preferred use of loops for all five digits, one or two of the loops for the inner fingers (index, middle and ring) may be eliminated, so that there are a thumb loop, a loop for the little finger, and loop(s) for one or more of the middle fingers.

FIG. 2 is a view of a snugly fitting finger loop 8 on the distal section of a finger 10. The width of the loop is advantageously about two-thirds of the length of the distal section, as shown in FIG. 2.

FIG. 3 is a cross-section cut at a right angle through fingers 12 and 14, band 4, and loops 16 and 18. Solid lines are in the relaxed position, dashed lines are in the finger-extended position. In FIG. 3, loops 16 and 18 are separate pieces, fasteners 19 such as brads, staples, sewn threads or adhesive attaching the ends to band 4.

In FIG. 4, band 4 is not a continuous band, but has ends 20 and 22. They are fitted with or made of the respective pieces of a VELCRO fastener, 23 being the multiple hooks and 24 being the material into which the hooks penetrate and hold and from which the hooks can be pulled out to separate the ends. The VELCRO ends 20 and 22 each has appreciable length so that adjustment of their respective positions adjusts the circumference of band 4.

A device with a continuous band 4 sized for the hand of an average adult person has a degree of adaptability to fit hands appreciably larger or smaller. However, if it is not comfortable for an individual, he or she can choose a VELCRO-fastened device. In practice, the manufacturer can offer three adult sizes plus a VELCRO adult size, and one or two sizes for teenagers and younger. Children's ligaments and muscles are generally sufficiently supple that tennis elbow seldom develops. It is most often found in power and tournament players, and recreational players who play frequently and especially if they do not keep in overall fit condition.

Figure 5:
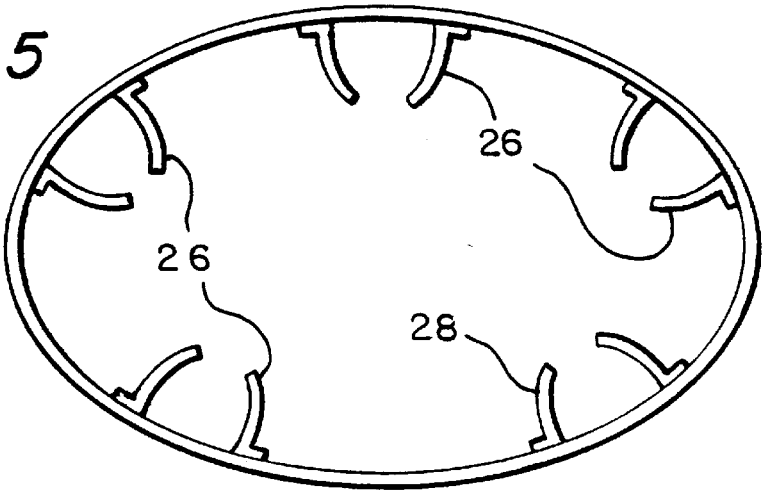
FIG. 5 is a plan view of a device of the invention in which the finger loops are partial rather than closed loops.

In FIG. 5, partial finger loops 26 and thumb loop 28 are open rather than closed. They are made from a material e.g. a molded elastomer, which preferably is sufficiently "springy" to allow easy insertion of a finger between the open ends or through the loop, but of sufficient stiffness to retain the fingers through the repeated cycles of exercise. The partial circumference of an open finger loop may be substantially greater than one-half that of a closed loop for the same finger.

FIG. 6 shows the device with an open linear elastic band 30 with two unattached ends, as contrasted to the circumferential band 4 of FIG. 1 and of sufficient length to extend across all five digits of the hand. The band bears finger loops 32 and thumb loop 34. They are spaced to fit comfortably on the fingers and thumb when the hand is in the normal open relaxed position, as explained above in connection with FIG. 1. The exercise is the same, i.e., the fingers and thumb are repeatedly extended and retracted. The band 30 is of sufficient elasticity to span the distance from thumb tip to little finger when fully extended. FIG. 6 has the preferred three loops for the inner fingers, but may instead have only one or two.

The form of FIG. 1 is generally preferred over that of FIG. 6. In the former, tension is applied directly between thumb and little finger, as well as amongst all of the digits. The FIG. 6 form of the invention does not provide tension directly between the thumb and the little finger. This may be advantageous for some forms of tennis elbow.

Figure 7:
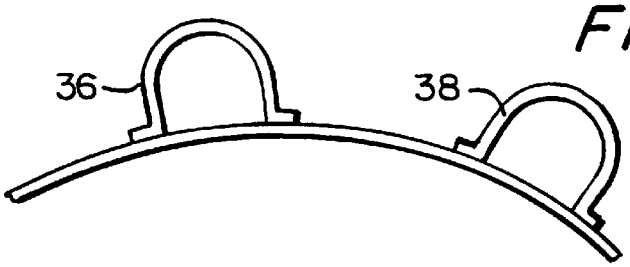
FIG. 7 illustrates a form of the invention in which the loops are on the outer side of the elastic band.

In FIG. 7, finger loops 36 and 38 are on the outer side of elastic band 4. This device may be originally manufactured in this form; or it may be obtained by turning the band 4 of FIG. 1 inside out, which places the loops on the outside rather than the inside of band 4.

The form of FIG. 1 has advantages over that of FIG. 7. The band 4 of FIG. 1, being on the periphery of the fingers, will be stretched more. In FIG. 7, the motive power to stretch the band is applied via the loops on the outside of band 4, and some of the tension against motion of the fingers will be caused by appreciable stretching of the loops rather than of the band. Some cases of tennis elbow may respond to the configuration of FIG. 7.

Figure 8:
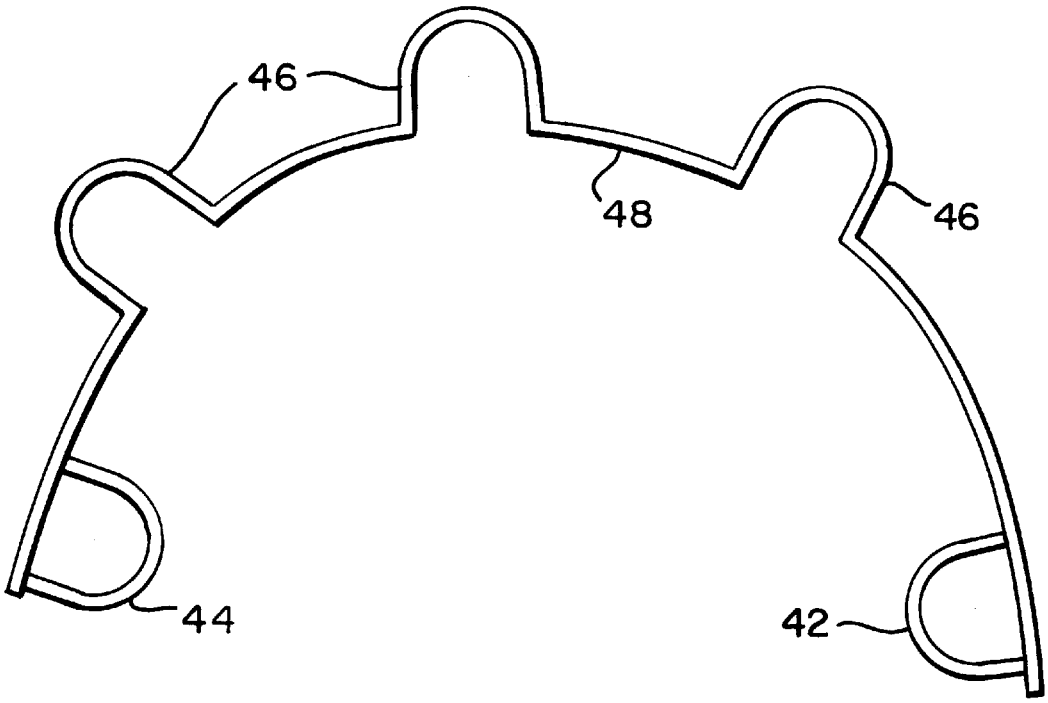
FIG. 8 shows a device that is a modification of FIG. 6, combining closed and open loops.

FIG. 8 illustrates a form of the invention in which the thumb loop 42 and the little finger loop 44 are closed loops, and the loops 46 for the middle fingers are partial loops. This is a modification of the elongated elastic band with two unattached ends shown in FIG. 6. But the same modification can be made of the closed elastic band of FIG. 1. In FIG. 8, the thumb loop 42 and the little finger loop 44 are on the inner side of elastic band 48; the middle loops 46 are on the outer side though they might also be deemed to be on the inner side since they open inwardly. Loops 46 are integral parts of band 48 and take the form of loops extending outwardly of band 48 and opening inwardly of band 48. Desirably, the device shown in FIG. 8 is a single integrated structure molded from an elastic material. Alternately, loops 46 may be joined to each other and to loops 42 and 44 by separate pieces of elastic band 48.

Various combinations in a single device of inside loops, outside loops, closed loops and open loops, with either a closed elastic band 4 (FIG. 1) or an open 2-ended band 30 (FIG. 6) or 48 (FIG. 8), may be devised as desired. Similarly, combinations in a single device of elastic and nonelastic loops may be employed. Likewise, retainers for one, two or all three middle fingers. All such combinations are within the scope of the present invention.

The recommended procedure for using the invention is as follows:

Slip finger holders over each finger; be sure that the thumb holder is on the thumb. These finger and thumb loops should fit snugly. Your hand should be in a relaxed, partly open position.

Do the following movements. Extend your fingers and your thumb outward away from the palm so that they also all spread out away from each other. Extending all the way is not necessary and may not be desirable. This movement will move your arm tendons and muscles and will be felt in your elbow. At first this will hurt, so just do the movement a few times (about 5 repetitions) per day. At the end of the first week, if the pain has lessened, increase your repetitions to 10 times, twice a day. After you are able to do this, usually at the end of about the second week, increase the number of repetitions, with the goal to increase their number to 15–25 times, 3 times a day (preferably morning, noon and night), for another full week, which should give you further easing of pain. Depending on the damage to the tendons and the level of discomfort, you can modify your movements to either more or fewer repetitions.

If the pain persists after five weeks, you should consider seeing your physician.

It is indicated above that extending fingers and thumb all the way may not be desirable. Before you place the device on your hand, let your hand hang loose; it will be partly open. Now start opening it farther, so that the fingers and thumb easily spread away from each other. When they reach a certain distance apart, pretty much in the plane of the open hand, you may find that further extension requires appreciably more effort and begins to put a strain on the knuckles and wrist. When you are exercising with the device, it is sufficient to stop your extensions at the certain distance just described.

What is claimed is:

1. A device for ameliorating the pain of tennis elbow, which comprises:

a closed band of elastic material of sufficient circumference to fit around and contact the outsides of all five digits of a hand;

on said band a retainer for retaining a thumb, a retainer for retaining a little finger, and retainer(s) for retaining one or more middle fingers;

whereby the wearer by repeatedly extending the fingers and thumb against the tension of the elastic band and stretching the band, then retracting the fingers and thumb, exercises the inflamed tendons and muscles resulting over time in amelioration of the tennis elbow pain.

2. A device according to claim 1, wherein said band fits comfortably around all five digits of the normal partly open relaxed hand, and said retainers are spaced from each other to correspond comfortably with the spacing of the digits of the normal partly open relaxed hand.

3. A device according to claim 1, having retainers for retaining all three of the middle fingers.

4. A device according to claim 1, wherein said retainers are loops or partial loops that fit snugly on the distal segments of their respective digits.

5. A device according to claim 4, wherein said loops or partial loops are on the inner side of said band.

6. A device according to claim 3, wherein the finger retainers are spaced about equally from each other, and the thumb retainer is a greater distance from the index finger retainer and a still greater distance from the little finger retainer.

7. A device according to claim 1, wherein said band is made of an elasticized fabric.

8. A device according to claim 4, wherein said loops or partial loops are made of an elastic material.

9. A device according to claim 8, wherein the said loops or partial loops are made of an elasticized fabric.

10. A device according to claim 8, wherein the said loops or partial loops are made of a molded elastomer.

11. A device according to claim 1, wherein the said band has overlapping ends adjustably positioned with respect to each other.

12. A device according to claim 11, wherein the band has overlapping VELCRO ends for adjusting the circumference of the band.

13. A device for ameliorating the pain of tennis elbow, which comprises:

an elongated band of elastic material with two unattached ends, of sufficient length to extend across all five digits of the hand;

on said band a retainer retaining the thumb, a retainer for retaining the little finger, and retainer(s) for retaining one or more of the middle fingers;

whereby the wearer by repeatedly extending the fingers and thumb against the tension of the elastic band and stretching the band, then retracting the fingers and thumb, exercises the inflamed tendons and muscles resulting over time in amelioration of the tennis elbow pain.

14. A device according to claim 13, having retainers for retaining all three of the middle fingers.

15. A device according to claim 14, wherein said band extends comfortably across all five digits of the normal partly open relaxed hand, and said retainers are spaced from each other to correspond comfortably with the spacing of the digits of the normal partly open relaxed hand.

16. A device according to claim 13, wherein said retainers are loops or partial loops that fit snugly on the distal segments of their respective digits.

17. A device according to claim 16, wherein said loops or partial loops are on the inner side of said band.

18. A device according to claim 16, wherein said loops or partial loops are on the outer side of said band.

19. A device according to claim 16, wherein said loops or partial loops are made of an elastic material.

20. A device according to claim 16, wherein the said band and/or loops or partial loops are made of an elasticized fabric.

21. A device according to claim 16, wherein the said band and/or loops or partial loops are made of a molded elastomer.

22. A device according to claim 21, wherein the said band and loops or partial loops constitute a single integrated molded structure.

23. A device according to claim 13, wherein one or more of said retainers are on the inner side and one or more of said retainers are on the outer side of said band.

24. A device according to claim 16 wherein one or more of said loops or partial loops are on the inner side and one or more of said loops or partial loops are on the outer side of said band.

25. A device according to claim 1, wherein between the retainers for the thumb and little finger are one or more finger retainer(s) that are integral parts of the band and that take the form of partial loop(s) extending outwardly of the band and opening inwardly of the band.

26. A device according to claim 13, wherein said band has retainers on or at its respective ends for thumb and little finger, respectively, and one or more finger retainer(s) between them that are integral parts of the band and that take the form of partial loop(s) extending outwardly of the band and opening inwardly of the band.

27. A device for ameliorating the pain of tennis elbow, which comprises:

a closed band of elastic material of sufficient circumference to contact the insides of all five digits of the hand;

on said band a retainer for retaining the thumb, a retainer for retaining the little finger, and retainer(s) for retaining one or more of the middle fingers;

wherein when said band is in a non-stretched condition: it fits comfortably within all five digits of the normal partly open relaxed hand, said retainers are spaced from each other to correspond comfortably with the spacing of the digits of the normal partly open relaxed hand, said finger retainers are spaced about equally from each other, and said thumb retainer is a greater distance from the index finger retainer and a still greater distance from the little finger retainer;

whereby the wearer by repeatedly extending the fingers and thumb against the tension of the elastic band and stretching the band, then retracting the fingers and thumb, exercises the inflamed tendons and muscles resulting over time in amelioration of the tennis elbow pain.

28. A device according to claim 27, having retainers for retaining all three of the middle fingers.

29. A device according to claim 27, wherein said retainers are loops or partial loops that fit snugly on the distal segments of their respective digits.

30. A device according to claim 29, wherein said loops or partial loops are on the outer side of said band.

31. A device according to claim 29, wherein said loops or partial loops are made of an elastic material.

32. A device according to claim 29, wherein one or more of said loops or partial loops are on the inner side and one or more of said loops or partial loops are on the outer side of said band.

33. A device according to claim 27, wherein between the retainers for the thumb and little finger are one or more finger retainer(s) that are integral parts of the band and that take the form of partial loop(s) extending outwardly of the band and opening inwardly of the band.

* * * * *